US008405565B2

(12) United States Patent
Kubo et al.

(10) Patent No.: US 8,405,565 B2
(45) Date of Patent: Mar. 26, 2013

(54) ANTENNA COIL

(75) Inventors: Hiroyuki Kubo, Kanazawa (JP); Hiromitsu Ito, Hakusan (JP); Kuniaki Yosui, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 13/439,918

(22) Filed: Apr. 5, 2012

(65) Prior Publication Data

US 2012/0188139 A1 Jul. 26, 2012

Related U.S. Application Data

(63) Continuation of application No. 12/542,026, filed on Aug. 17, 2009, now Pat. No. 8,179,332, which is a continuation of application No. PCT/JP2008/050937, filed on Jan. 24, 2008.

(30) Foreign Application Priority Data

Mar. 9, 2007 (JP) ..... 2007-060063

(51) Int. Cl.
*H01Q 7/08* (2006.01)

(52) U.S. Cl. ..... 343/788; 343/787

(58) Field of Classification Search ..... 343/788, 343/787, 867, 742
See application file for complete search history.

(56) References Cited

U.S. PATENT DOCUMENTS

| | | | | |
|---|---|---|---|---|
| 4,805,232 | A * | 2/1989 | Ma | 455/291 |
| 5,923,300 | A * | 7/1999 | Mejia | 343/788 |
| 6,930,646 | B2 * | 8/2005 | Yahata et al. | 343/718 |
| 7,123,206 | B2 * | 10/2006 | Hess et al. | 343/788 |
| 7,508,350 | B2 * | 3/2009 | Hein et al. | 343/787 |

OTHER PUBLICATIONS

Kubo et al.; "Antenna Coil and Antenna Device"; U.S. Appl. No. 12/542,026, filed Aug. 17, 2009.

* cited by examiner

*Primary Examiner* — Hoang V Nguyen
(74) *Attorney, Agent, or Firm* — Keating & Bennett, LLP

(57) ABSTRACT

An antenna coil includes a magnetic layer such as a flat magnetic sheet, a transmission coil portion defined by a coiled conductor, a reception coil portion defined by a coiled conductor, a transmission coil connection defined by the conductor and defining a portion of the transmission coil portion, and a reception coil connection defined by the conductor and defining a portion of the reception coil portion. The transmission coil portion and the reception coil portion are at least partly formed side by side on the magnetic layer and are arranged to be connected to a wiring pattern on an external circuit.

4 Claims, 8 Drawing Sheets

ANTENNA COIL

BACKGROUND OF THE INVENTION

1. Field of the Invention

The present invention relates to an antenna coil for use in a radio frequency identification (RFID) system that communicates with an external apparatus using an electromagnetic signal and to an antenna device including the antenna coil.

2. Description of the Related Art

In RFID systems, which are being increasingly used in recent years, a mobile electronic device (e.g., a mobile phone) and a reader/writer both have an antenna for information communications mounted therein and exchange data therebetween.

An antenna coil for use in a tag employing the RFID technique is disclosed in Japanese Unexamined Patent Application Publication No. 2002-252518. FIG. 1 is an illustration that shows an example structure of an antenna coil described in Japanese Unexamined Patent Application Publication No. 2002-252518. In this antenna coil 11, an electrical insulating film 13 including conductors 14 and 16 formed on its surfaces is bent such that a flat-shaped magnetic core member 12 is sandwiched, and the ends are connected to form a coil. The use of an electrical insulating film in such a way enables the antenna coil to have a structure that is thinner than that in which a conductor is wound around a magnetic core member.

However, if the antenna coil described in Japanese Unexamined Patent Application Publication No. 2002-252518 is embedded in a mobile phone while the main surface of the antenna coil is arranged so as to be parallel with the main surface of the mobile phone, because the coil axis of the coil is parallel with the main surface of the mobile phone and the main surface of the antenna coil has no portion for allowing an intrusion of magnetic flux, only magnetic flux from the side of the antenna coil will pass through the coil axis of the antenna coil. Therefore, in actuality, communications cannot be performed. In order to utilize the antenna coil described in Japanese Unexamined Patent Application Publication No. 2002-252518 in a mobile phone, it is necessary to arrange the antenna coil in a direction perpendicular to the main surface of the mobile phone. Such a structure cannot allow the antenna coil to be used as one that can be mounted on a circuit board, and a structure for embedding and an operation therefor are inevitably complicated.

SUMMARY OF THE INVENTION

In view of the above, preferred embodiments of the present invention provide an antenna coil, the antenna coil allowing communications to be performed while magnetic flux intrudes into the antenna coil from a direction perpendicular or substantially perpendicular to the main surface of the antenna coil and being readily embeddable in an electronic apparatus.

An antenna coil according to a preferred embodiment of the present invention includes a magnetic layer, a transmission coil portion defined by a coiled conductor, a reception coil portion defined by a coiled conductor, a transmission coil connection defined by the conductor and defining a portion of the transmission coil portion, a reception coil connection defined by the conductor and defining a portion of the reception coil portion, wherein the transmission coil portion and the reception coil portion are at least partly formed side by side on the magnetic layer, and are arranged to be connected to a wiring pattern on an external circuit.

Preferably, the transmission coil portion and the reception coil portion may be arranged on the same flat magnetic layer.

The coiled conductor may preferably be formed on a flexible substrate.

According to various preferred embodiments of the present invention, the following advantages are provided.

The transmission coil portion and the reception coil portion arranged on the magnetic layer such as a magnetic sheet and partly formed side by side can hold the transmission coil portion and the reception coil portion independently from each other and can reduce an area required to form the coil portions.

In addition, the transmission coil portion and the reception coil portion arranged on the same flat magnetic layer can reduce the number of parts required to form the coil portions.

Furthermore, the coiled conductor formed on the flexible substrate can be thinner and can be easily connected to an external circuit.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

First Preferred Embodiment

A structure of an antenna coil according to a first preferred embodiment is described with reference to FIGS. 2A and 8.

Figure 1:
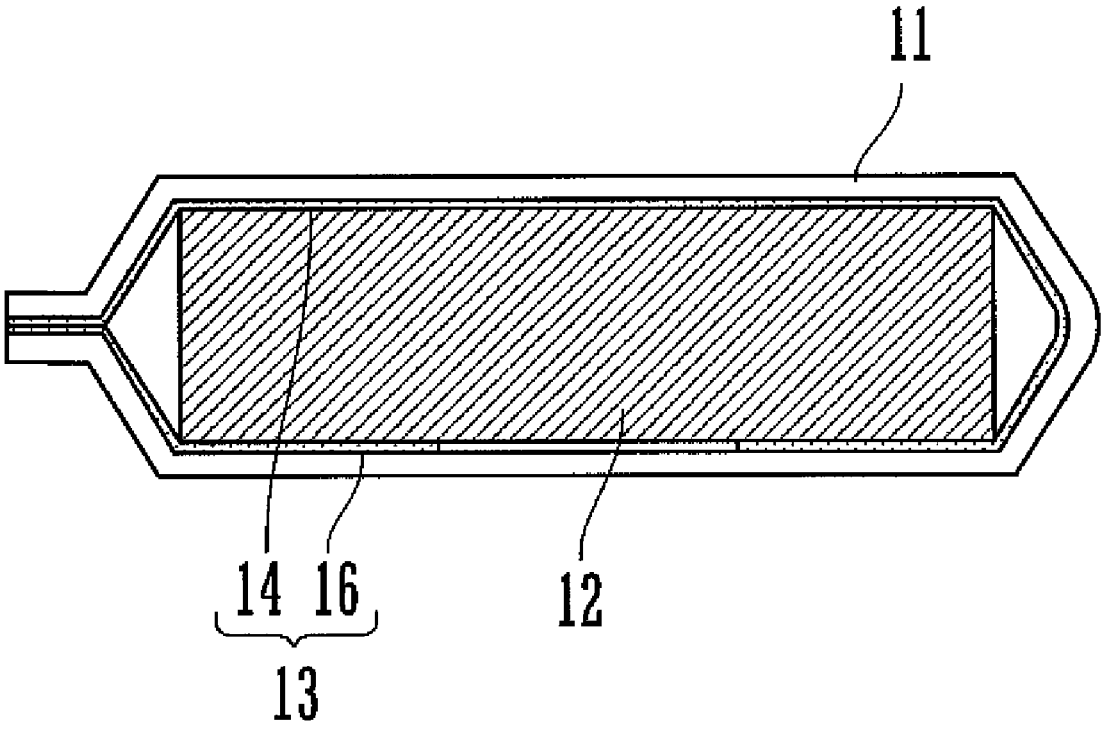
FIG.1 PRIOR ART
FIG. 1 is an illustration that shows an example structure of an antenna coil described in Japanese Unexamined Patent Application Publication No. 2002-252518.
Figure 2A:
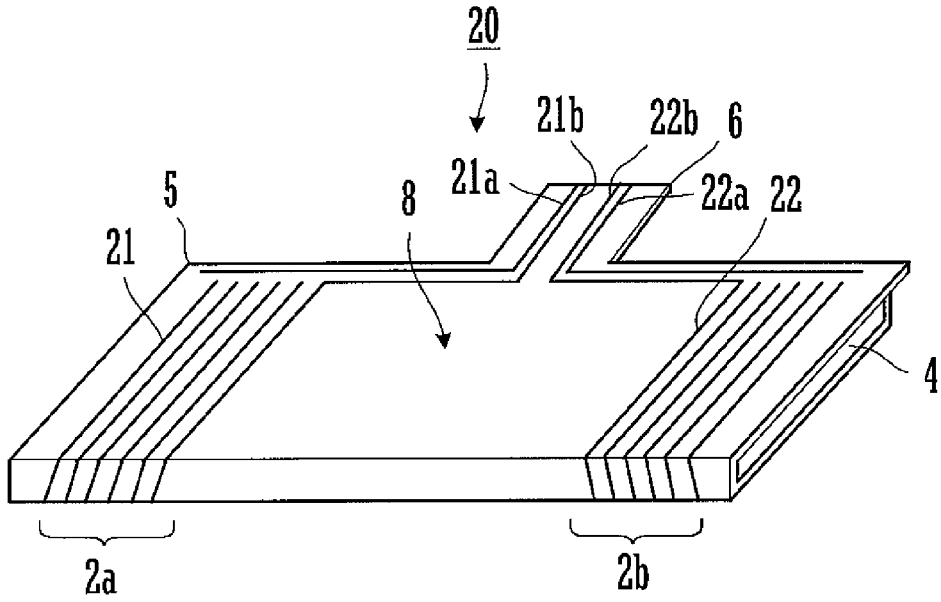
FIG. 2A and FIG. 2B are illustrations that show a structure of an antenna coil according to a first preferred embodiment of the present invention.
Figure 2B:
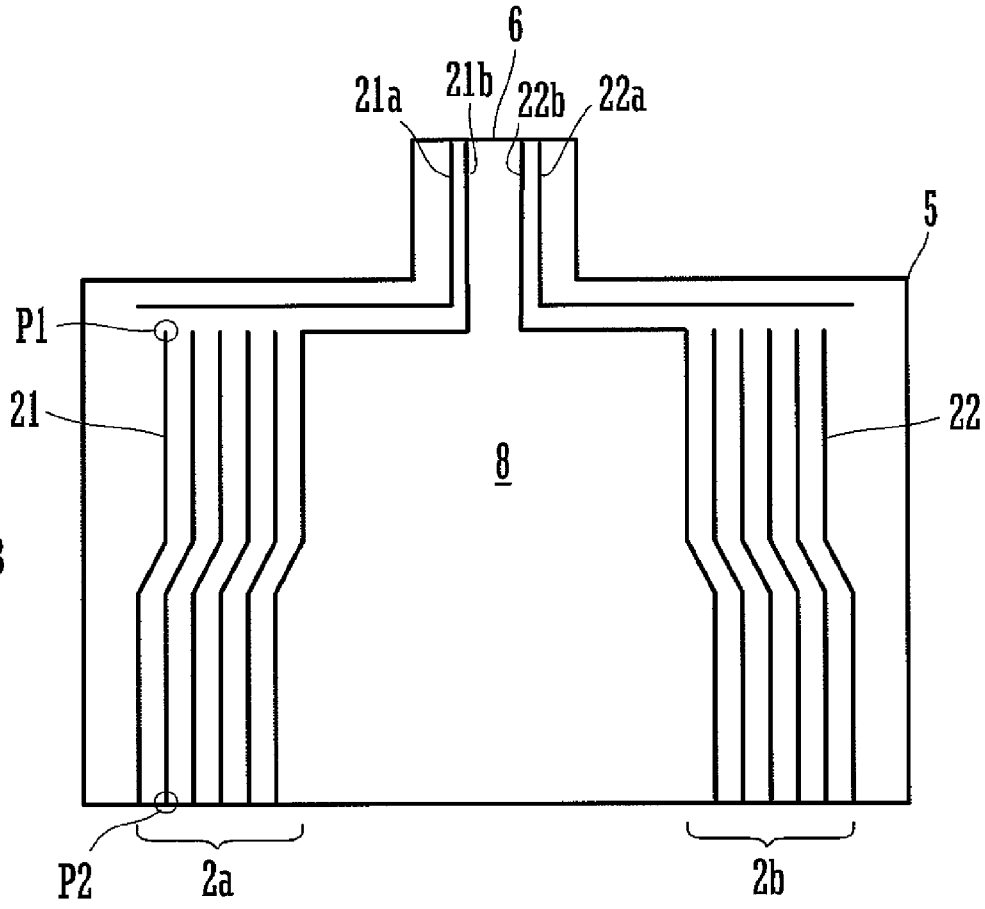

FIG. 2A and FIG. 2B are illustrations that show a structure of an antenna coil 20 according to the first preferred embodiment. FIG. 2A is a perspective view thereof, and FIG. 2B is a developed plan view that shows a structure of a flexible substrate before it is wound on a magnetic core.

As illustrated in FIG. 2A and FIG. 2B, the antenna coil 20 according to the first preferred embodiment includes a magnetic core 4 and a single flexible substrate 5 wound around the magnetic core 4.

A ferrite core that preferably has a rectangular or substantially rectangular main surface of about 30 mm in a horizontal direction and about 10 mm in a vertical direction thereof and having a thickness of about 1.5 mm is preferably used in the magnetic core 4, for example.

A polyimide film, for example, is suited for the flexible substrate 5. Aside from it, a bendable electric insulating film, such as a resin film (e.g., a glass epoxy film) can also be used. A conductor is provided on the surface of the flexible substrate 5. The conductor preferably defines and includes a first coil portion 2*a* and a second coil portion 2*b* around the magnetic core 4. Specifically, the first coil portion 2*a* includes, for example, a first coil 21 including 6 turns of about 1 mm pitch in the vicinity of the left edge of the magnetic core 4 such that the first coil 21 is arranged at and inside the position about 1 mm in from the left edge of the magnetic core 4. Similarly, the second coil portion 2*b* includes, for example, a second coil 22 including 6 turns of about 1 mm pitch in the vicinity of the right edge of the magnetic core 4 such that the second coil 22 is arranged at and inside the position about 1 mm in from the right edge of the magnetic core 4. The winding direction of the first coil 21 to the coil axis is opposite to that of the second coil 22.

The flexible substrate 5 includes a projection 6 located at an intermediate position of one longer side thereof. At the projection 6, both ends of the first coil 21 are drawn out as first connections 21*a* and 21*b*, and similarly, both ends of the second coil 22 are drawn out as second connections 22*a* and 22*b*.

The flexible substrate 5 includes a conductor-free portion 8 between the first coil portion 2*a* and the second coil portion 2*b*.

In FIG. 2B, six conductor sections, for example, are provided in the vicinity of each of both right and left ends of the flexible substrate 5 on the surface thereof. Although each of the conductor sections is illustrated with a single line, the conductor section preferably has a width of about 0.5 mm to about 1 mm and a thickness of about 0.01 mm to about 0.05 mm in actuality, for example. In FIG. 2B, each of the conductor sections is in contact with the lower end of the flexible substrate 5, but is separated from the upper end thereof. These conductor sections are formed by, for example, screen printing.

The flexible substrate 5 illustrated in FIG. 2B is bent so as to sandwich the magnetic core 4 such that the upper ends of the conductor sections and the lower ends thereof overlap each other and so as to arrange the surface where the conductor sections are formed outside. The overlapping points, for example, the point P1 and point P2 indicated by circles in FIG. 2B are electrically connected together by, for example, soldering. This forms the conductor sections as a continuous coil. Because the flexible substrate 5 is significantly thin, even if the overlapping points are not directly bonded together, these points can be electrically connected through the flexible substrate 5.

The antenna coil 20 illustrated in FIG. 2A and FIG. 2B are mounted to a circuit board, and the first connections 21*a* and 21*b* and the second connections 22*a* and 22*b* at the projection 6 of the flexible substrate 5 are connected to a wiring pattern on the circuit board. For the circuit board, the first coil 21 and the second coil 22 are connected in series or parallel in a direction in which induced voltages are added, in accordance with the wiring pattern. In the present preferred embodiment, because the winding direction of the first coil 21 to the coil axis and that of the second coil 22 are opposite to each other, in order to connect them in series, the inner end of the first coil 21 and the inner end of the second coil 22, i.e., the first connection 21*b* and the second connection 22*b* are connected. In order to connect them in parallel, the inner end of the first coil 21 and the outer end of the second coil 22, and the outer end of the first coil 21 and the inner end of the second coil 22, i.e., the first connection 21*b* and the second connection 22*a* are connected, and the first connection 21*a* and the second connection 22*b* are connected. By use of such a connection, induced voltages occurring in the first coil 21 and the second coil 22 can be added.

When communications with a reader/writer for use in an RFID system are performed using the antenna coil 20 having the unique structure as described above, magnetic flux intrudes into the conductor-free portion 8 of the antenna coil 20 from the reader/writer. Therefore, the conductor-free portion 8 is configured to have a sufficient size. However, because it is necessary for the magnetic flux intruding into the conductor-free portion 8 to pass through the magnetic core 4 toward the opposite ends thereof, it is also required that a structure in which too large of an area of the conductor-free portion 8 causes difficulty in guiding the magnetic flux to the opposite ends of the magnetic core 4 be avoided. In the present preferred embodiment, the opposite ends of the magnetic core 4 on which the magnetic flux is focused are formed as the first coil portion 2*a* and the second coil portion 2*b*, thus resulting in a structure in which the magnetic flux intruding into the magnetic core 4 from the conductor-free portion 8 facilitates the first coil 21 and the second coil 22 to induce voltage.

Because the first coil 21 and the second coil 22 are not connected on the flexible substrate 5, it is possible to change characteristics in accordance with a connecting method even after the antenna coil 20 is produced. In particular, when the first coil 21 and the second coil 22 are connected in parallel, the series resistance is smaller and the Q factor is larger than those occurring when they are connected in series. If the first coil 21 and the second coil 22 are connected in parallel on the flexible substrate 5, the pattern will be complicated. However, connecting them on the circuit board raises no such problem.

In the first preferred embodiment, the first coil 21 and the second coil 22 preferably are symmetrically arranged with respect to the magnetic core 4. Therefore, the magnetic fluxes intruding into both the coils can be the same. Because the number of turns and the coil axis of the first coil 21 is the same as those of the second coil 22, a voltage induced in the first coil 21 and that in the second coil 22 can be the same.

In the first preferred embodiment, the magnetic core 4 preferably has a rectangular parallelepiped shape, for example. However, the present invention is not limited to this preferred embodiment, so the magnetic core 4 may be in the form of a polygonal column or a circular cylinder, or other suitable shape.

The size of the first coil 21 and the number of turns in the first coil 21 may be different from those of the second coil 22. If the number of turns in the second coil 22 is larger than that in the first coil 21, a voltage induced in the second coil 22 is larger than that in the first coil 21. This configuration enables linkage not only to the magnetic flux perpendicular to the direction of the coil axis of the antenna coil but also to the magnetic flux parallel with the direction of the coil axis of the antenna coil. That is, when the magnetic flux parallel with the direction of the coil axis with respect to the antenna coil passes, a voltage induced in the first coil 21 and that in the second coil 22 are opposite to each other. However, the induced voltages have different magnitudes, so they are not fully cancelled. Therefore, even when magnetic flux parallel with the direction of the coil axis of the antenna coil intrudes, the magnetic flux enables communications.

In this preferred embodiment, the coil axis of the first coil 21 coincides with that of the second coil 22. However, even if the coil axes do not exactly coincide with each other, magnetic flux perpendicular to the direction of the coil axis of the antenna coil can be guided to each coil portion.

In this preferred embodiment, in producing the antenna coil 20, the flexible substrate 5 can also be bent such that the surface where the conductor sections are formed is arranged inside. In this case, the conductor sections are not exposed at the front surface of the antenna coil 20, so the antenna coil has the structure in which the conductor sections are less prone to peeling off.

In this preferred embodiment, the flexible substrate 5 includes the projection 6 used for drawing the first and second coil connections. However, connection between the coil connections and the wiring pattern of the circuit board is not limited to this preferred embodiment. Additionally, in this preferred embodiment, the winding direction of the first coil 21 to the coil axis is opposite to that of the second coil 22. However, the winding directions may be the same as long as the coils are connected using the wiring pattern of the circuit board to which the antenna coil is mounted such that induced voltages are added.

When the above-described antenna coil is used in the antenna device for use in communications, it is preferable that the resonant frequency of a resonant circuit defined by the inductance value of the antenna coil and the capacitance value of a capacitor match with the frequency of a communication signal. However, because the resonant frequency varies with variations in permeability of the magnetic core, adjustment (trimming) of the inductance value of the antenna coil is necessary in general. However, as described below, the use of a magnetic core that has relative permeability equal to or larger than 100 can provide satisfactory characteristics of communications without adjustment. Although the L (inductance) value increases with an increase in permeability of the magnetic core, when the relative permeability exceeds 100, the rate of change in L value decreases and it is in saturation. Therefore, when an antenna coil is produced such that the target value of relative permeability exceeds 100, even if the relative permeability of the magnetic core of the actually produced antenna coil varies in a wide range from 100, the L value falls within a given range. Specifically, in order to stabilize characteristics of communications of the antenna coil, it is preferable to restrict variations in the L value to approximately ±1%. However, even if the relative permeability of the magnetic core of the antenna coil produced such that the target value of the relative permeability is 100 varies in a range of about ±10%, variations in the L value can be restricted to a range of about ±1%.

The following table shows results of an investigation of a relationship between the inductance value L of an antenna coil in which a 5-turn first coil is arranged in one end of a magnetic core of 40×10×1 [mm] and a 5-turn second coil is arranged in the other end thereof with respect to relative permeability μ of the magnetic core and its variations.

| μ | Center Value of L | μ for −1% of L Value | μ for +1% of L Value |
|---|---|---|---|
| 60 | 1.166 | 56.5(−3.5) | 64.0(+4.0) |
| 80 | 1.215 | 74.2(−5.8) | 86.5(+6.5) |
| 100 | 1.246 | 90.7(−9.3) | 111.8(+11.8) |

Figure 8:
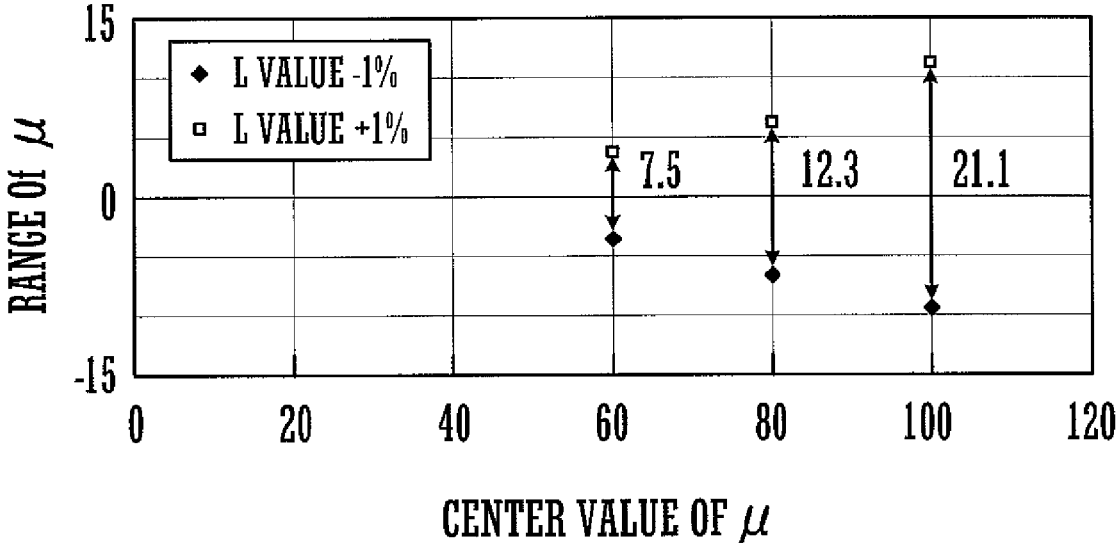
FIG. 8 is an illustration that shows a range of relative permeability μ of a magnetic core for ±1% of inductance value L of the antenna coil.

FIG. 8 illustrates a range of relative permeability μ for ±1% of the above inductance value L. As described above, when the relative permeability of the magnetic core is at or above 100, μ has a range of about 21.1. Accordingly, it is possible to restrict variations in inductance value to about ±1% or less merely by the use of the magnetic core in which variations in permeability are approximately 20%, so this obviates the necessity to trim the inductance value.

Second Preferred Embodiment

A structure of an antenna device according to a second preferred embodiment will be described with reference to FIGS. 3 and 4.

Figure 3:
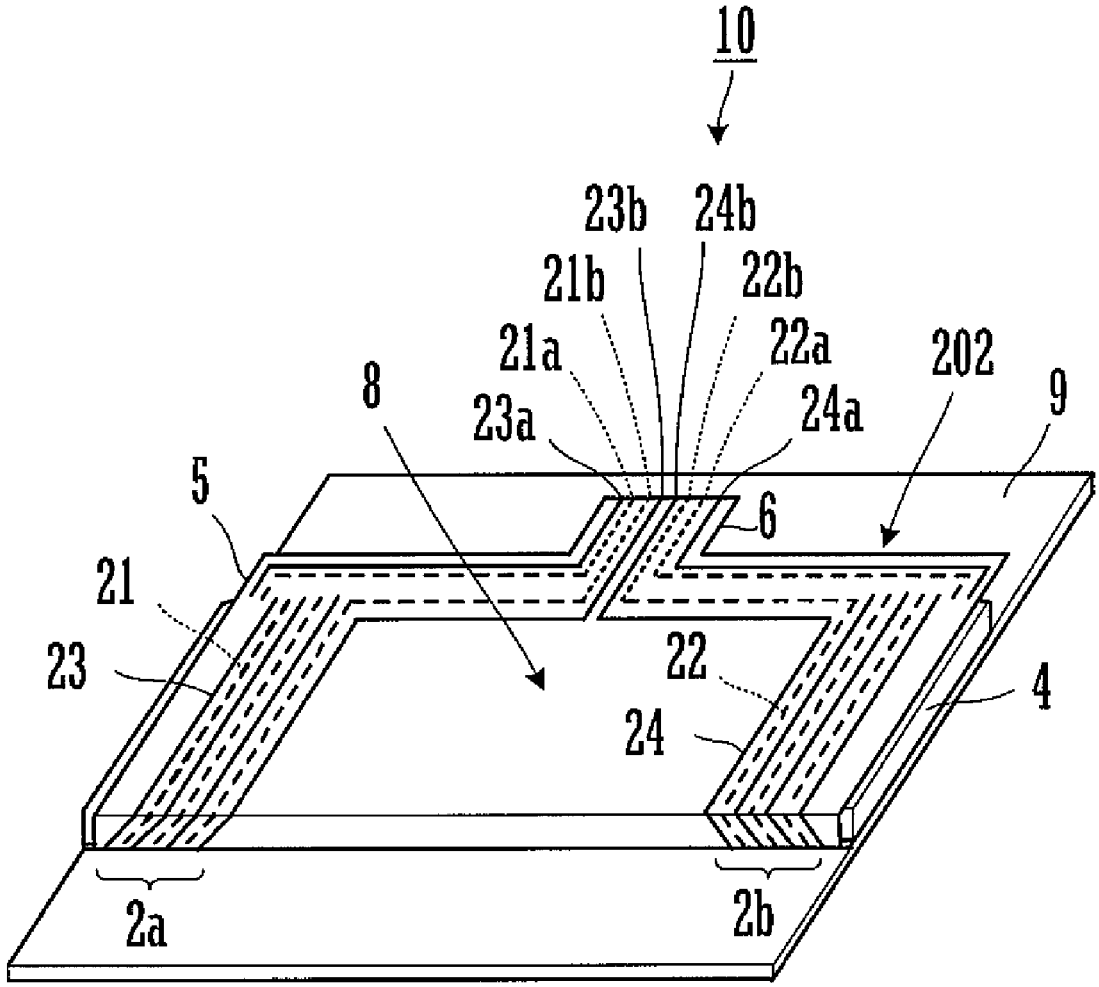
FIG. 3 is a perspective view that shows a structure of an antenna device according to a second preferred embodiment of the present invention.

FIG. 3 is a perspective view that illustrates a structure of an antenna device 10 according to the second preferred embodiment. FIG. 4 is a developed plan view that illustrates a flexible substrate before the flexible substrate is wound on a magnetic core of an antenna coil defining a portion of the antenna device.

The antenna device 10 illustrated in FIG. 3 is preferably formed by mounting of an antenna coil 202 to a circuit board 9.

The antenna coil 202 includes a magnetic core 4 and a single flexible substrate 5 wound around the magnetic core 4.

A conductor is provided on the surface of the flexible substrate 5. The conductor defines a first coil portion 2*a* and a second coil portion 2*b* around the magnetic core 4. Specifically, the first coil portion 2*a* includes, for example, a third coil 23 including 4 turns and a first coil 21 including 3 turns at about 2 mm pitch from the location about 1 mm inside the left edge of the magnetic core 4. Similarly, the second coil portion 2*b* includes, for example, a fourth coil 24 including 4 turns and a second coil 22 including 3 turns at about 2 mm pitch from the location about 1 mm inside the right edge of the magnetic core 4.

The winding direction of the first coil 21 to the coil axis is opposite to that of the second coil 22. The winding direction of the third coil 23 to the coil axis is opposite to that of the fourth coil 24.

The flexible substrate 5 includes a projection 6 formed in an intermediate position of one longer side thereof. At the projection 6, both ends of the first coil 21 are drawn out as first connections 21*a* and 21*b*, and similarly, both ends of the second coil 22 are drawn out as second connections 22*a* and 22*b*. Both ends of the third coil 23 are drawn out as third connections 23*a* and 23*b*. Similarly, both ends of the fourth coil 24 are drawn out as fourth connections 24*a* and 24*b*.

The flexible substrate 5 includes a conductor-free portion 8 between the first coil portion 2*a* and the second coil portion 2*b*.

Figure 4:
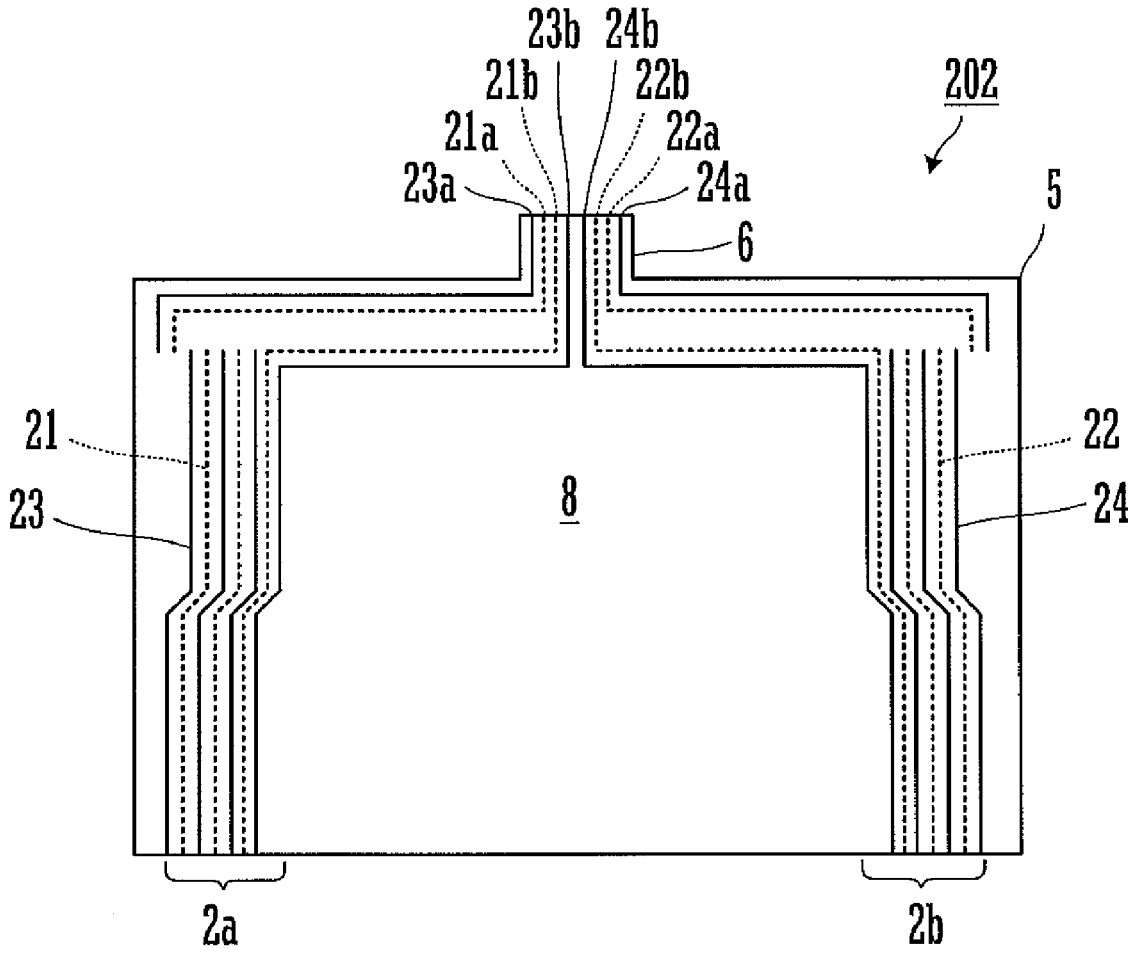
FIG. 4 is another illustration that shows a structure of the antenna coil according to the second preferred embodiment of the present invention.

The flexible substrate 5 illustrated in FIG. 4 is bent so as to sandwich the magnetic core 4 such that the upper ends of the conductor sections and the lower ends thereof overlap each other and so as to arrange the surface where the conductor sections are located outside. The overlapping points are electrically connected together by, for example, soldering. This forms the conductor sections as a continuous coil.

Structures of the other components preferably are substantially the same as those in the first preferred embodiment.

The antenna coil 202 illustrated in FIG. 3 is mounted to the circuit board 9, and the first connections 21*a* and 21*b*, the second connections 22*a* and 22*b*, the third connections 23*a* and 23*b*, and the fourth connections 24*a* and 24*b* at the projection 6 of the flexible substrate 5 are connected to a wiring pattern on the circuit board. The set of the first and second coils is used as a receiving antenna, and the set of the third and fourth coils is used as a transmitting antenna.

When communications with a reader/writer for use in an RFID system are performed using the antenna device 10 structured in the above-described way, magnetic flux intrudes into the conductor-free portion 8 of the antenna coil 202 from the reader/writer. The magnetic flux not only passes across the magnetic core 4 but also is blocked by the conductor sections on the circuit board, thus changes its path, and passes through the coil axis of each of the first to fourth coils 21 to 24.

By connecting the connections at the projection 6 to the circuit board, the first coil 21 and the second coil 22 are connected in series or parallel using the wiring pattern of the circuit board in a direction in which induced voltages are added. Similarly, the third coil 23 and the fourth coil 24 are connected in series or parallel in a direction in which induced voltages are added. The set of the first and second coils is used as a receiving antenna. The set of the third and fourth coils is used as a transmitting antenna.

Providing a receiving antenna and a transmitting antenna independently obviates the necessity to switch the antenna coil using a control circuit between a case where it functions as the one for reception and a case where it functions as the one for transmission.

In this preferred embodiment, the first coil portion 2*a* preferably includes an arrangement of the first coil 21 and the third coil 23 in an alternating manner, and the second coil portion 2*b* includes an arrangement of the second coil 22 and the fourth coil 24 in an alternating manner. Therefore, all of a total of four coils can be disposed on a single side of the flexible substrate. Accordingly, the cost of the flexible substrate 5 can be reduced. Alternately arranging the coils allows the coil unit for transmission and the coil unit for reception to be located in substantially the same region. Therefore, the position that can provide the highest sensitivity when the antenna device is held over a reader/writer for reception and that for transmission can be the same. Of course, two coils for transmission and another two coils for reception may be disposed on different surfaces of the flexible substrate. In this case, the cost of the flexible substrate 5 is increased, but the region for the first coil portion 2*a* and the region for the second coil portion 2*b* can be reduced.

Third Preferred Embodiment

A structure of an antenna device according to a third preferred embodiment will be described with reference to FIG. 5.

Figure 5:
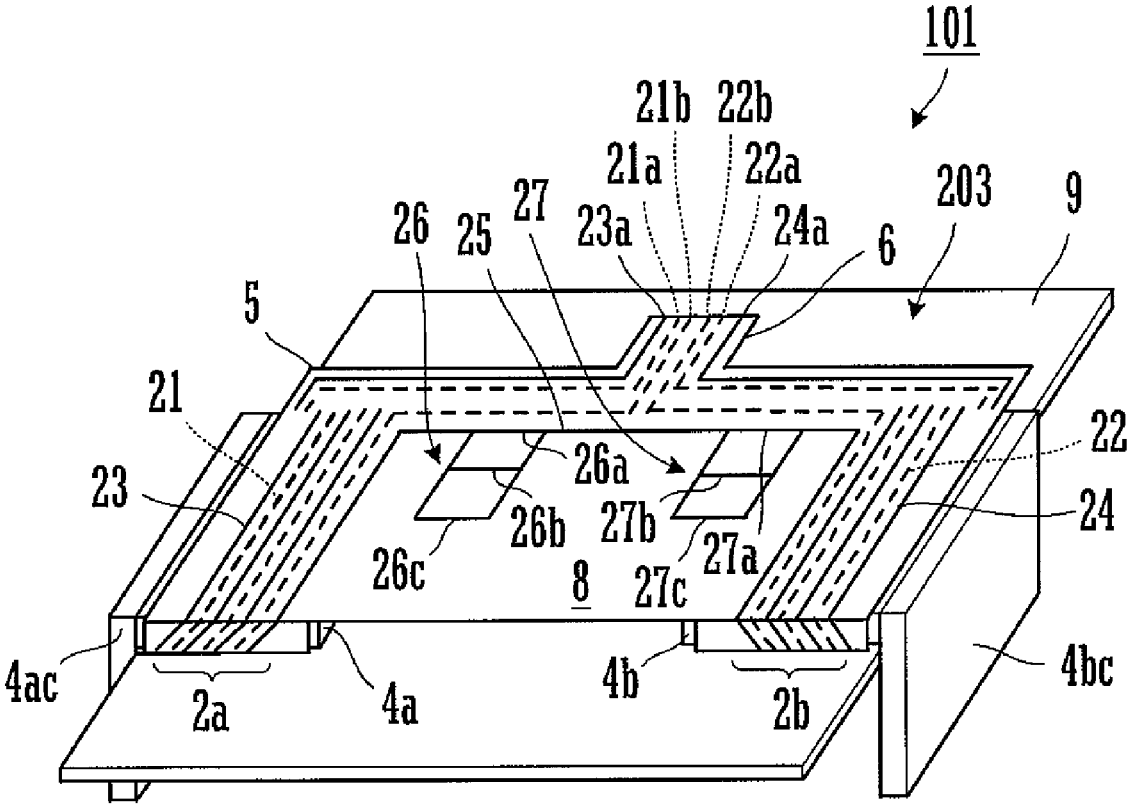
FIG. 5 is an illustration that shows a structure of an antenna device according to a third preferred embodiment of the present invention.

FIG. 5 is a perspective view that illustrates a structure of an antenna device 101 according to the third preferred embodiment.

As illustrated in FIG. 5, the antenna device 101 according to the third preferred embodiment is preferably formed by mounting of an antenna coil 203 to a circuit board 9.

The antenna coil 203 includes a first core piece 4*a*, a second core piece 4*b*, and a flexible substrate 5 wound around the first core piece 4*a* and the second core piece 4*b*.

A ferrite plate having, for example, a substantially rectangular main surface of about 8 mm in a horizontal direction and about 10 mm in a vertical direction and a thickness of about 1.5 mm is preferably used in each of the first core piece 4*a* and the second core piece 4*b*. The side of the main surface in the horizontal direction of the first core piece 4*a* and that in the vertical direction are collinear. The distance between the first core piece 4*a* and the second core piece 4*b* was about 24 mm. A conductor-free portion 8 is provided between the first core piece 4*a* and the second core piece 4*b*, which are arranged in such a way.

A first coil portion 2*a* and a second coil portion 2*b* are defined by conductor sections on the surface of the flexible substrate 5 around the first core piece 4*a* and the second core piece 4*b*, respectively. Specifically, the first coil portion 2*a* includes, for example, a third coil 23 including 4 turns and a first coil 21 including 3 turns at about 2 mm pitch from the location about 1 mm inside the left edge of the first core piece 4*a*. Similarly, the second coil portion 2*b* includes, for example, a fourth coil 24 including 4 turns and a second coil 22 including 3 turns at about 2 mm pitch from the location about 1 mm inside the right edge of the second core piece 4*b*.

The winding direction of the first coil 21 to the coil axis is opposite to that of the second coil 22. Similarly, the winding direction of the first coil 21 to the coil axis is opposite to that of the second coil 22.

The coil axis of each coil in the first coil portion 2*a* and that in the second coil portion 2*b* are parallel or substantially parallel with a horizontal direction of the first core piece 4*a* and that of the second core piece 4*b*, respectively.

The inner end of the third coil 23 and the inner end of the fourth coil 24 are connected by a connecting conductor 25 on the surface of the flexible substrate 5. Additionally, the connecting conductor 25 includes two inductance adjustment conductors 26 and 27.

The flexible substrate 5 includes a projection 6 located at an intermediate position of one longer side thereof. At the projection 6, both ends of the first coil 21 are drawn out as first connections 21*a* and 21*b*, and similarly, both ends of the second coil 22 are drawn out as second connections 22*a* and 22*b*. A single end of the third coil 23 is drawn out as a third connection 23*a*. Similarly, a single end of the fourth coil 24 is drawn out as a fourth connection 24*a*.

Structures of the other components preferably are substantially the same as those in the first and second preferred embodiments.

The inductance adjustment conductor 26 preferably includes three current paths 26*a*, 26*b*, and 26*c*. Three different current paths are selectable by maintaining one path and trimming (disconnecting) the other two paths among them. Similarly, the inductance adjustment conductor 27 includes three current paths 27*a*, 27*b*, and 27*c*. Three different current paths are selectable by maintaining one path and trimming (disconnecting) the other two paths among them. Selecting a combination of these current paths can adjust the inductance of the antenna coil unit for the set of the third and fourth coils.

The outer end of the first core piece 4*a* is provided with a magnetic-core bend 4*ac* extending in a direction that is perpendicular or substantially perpendicular to the direction of the coil axis. Similarly, the outer end of the second core piece 4*b* is provided with a bend 4*bc*. Each of the bends 4*ac* and 4*bc* is made of ferrite, as in the case of the first core piece 4*a* and the second core piece 4*b*. The bends 4*ac* and 4*bc* are bonded to the end of the first core piece 4*a* and that of the bend 4*bc*, respectively. The provision of the bends 4*ac* and 4*bc* increases the cross-sectional area of each of the first and second core pieces in a direction perpendicular or substantially perpendicular to the circuit board 9 at the respective ends of the first and second core pieces. Therefore, the magnetic reluctance in the end of the antenna coil 203 in the direction of the coil axis can be reduced.

The magnetic-core bends 4*ac* and 4*bc* are arranged outside the opposite ends of the circuit board 9 when the antenna coil 203 is mounted to the circuit board 9. This configuration avoids the magnetic-core bends 4*ac* and 4*bc* from being affected by the conductor provided on the circuit board 9, the magnetic reluctance in the end of the antenna coil 203 in the direction of the coil axis can be further reduced. Accordingly, the flux gathering effect of the antenna coil is improved, so the antenna device can have high communication sensitivity. Because the antenna coil 203 can be formed so as to be fitted with the shape of the circuit board 9, the antenna device 101 including the antenna coil 203 and the circuit board 9 can be miniaturized.

Such advantages are obtainable not only when the bends 4*ac* and 4*bc* are bonded to their respective ends, as in the present preferred embodiment, but also when the bends 4*ac* and 4*bc* are formed integrally with the first core piece 4*a* and the second core piece 4*b*, respectively. The shape of each of the bends 4*ac* and 4*bc* is not limited to a rectangular parallelepiped and can be any suitable shape.

In this preferred embodiment, the magnetic core divided into the first core piece 4*a* and the second core piece 4*b* was preferably used. It is believed that the antenna sensitivity is not reduced even when the conductor-free portion 8 for allowing intrusion of magnetic flux has no magnetic core. Therefore, the division of the magnetic core reduces the volume of the antenna coil, so the size and weight of the antenna coil can be reduced while the antenna sensitivity is maintained.

Fourth Preferred Embodiment

A structure of an antenna device according to a fourth preferred embodiment will be described with reference to FIG. 6.

Figure 6:
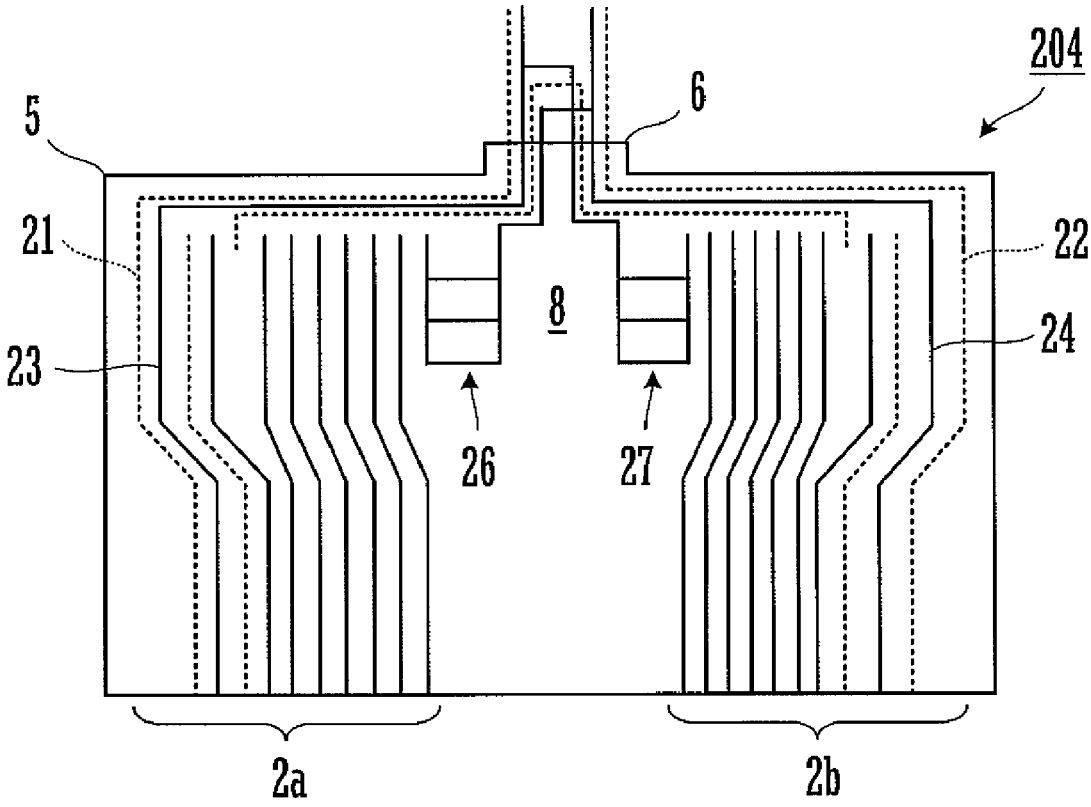
FIG. 6 is an illustration that shows a structure of an antenna coil according to a fourth preferred embodiment of the present invention.

FIG. 6 illustrates a structure of an antenna coil 204 according to the fourth preferred embodiment. FIG. 6 is a developed plan view that shows a structure of a flexible substrate before the flexible substrate is wound on a magnetic core and also illustrates a portion of a conductor pattern on a circuit board to which the antenna coil is to be mounted. The magnetic core preferably is substantially the same as in the first and second preferred embodiments, so it is omitted in the drawing.

As illustrated in FIG. 6, the antenna coil 204 according to the fourth preferred embodiment includes a single flexible substrate 5 to be wound around the magnetic core. A conductor is provided on the surface of the flexible substrate 5. The conductor defines a first coil portion 2*a* and a second coil portion 2*b* around the magnetic core. Specifically, the first coil portion 2*a* includes, for example, a first coil 21 including 2 turns and a third coil 23 including 8 turns. Similarly, the second coil portion 2*b* includes, for example, a second coil 22 including 2 turns and a fourth coil 24 including 8 turns.

The winding direction of the first coil 21 to the coil axis is opposite to that of the second coil 22. The winding direction of the third coil 23 to the coil axis is opposite to that of the fourth coil 24.

Inductance adjustment conductors 26 and 27 electrically connected to the inner end of the third coil 23 and the inner end of the fourth coil 24, respectively, are provided on the surface of the flexible substrate 5.

The flexible substrate 5 includes a projection 6 located at an intermediate position of one longer side thereof. At the projection 6, both ends of the first coil 21 and both ends of the second coil 22 are drawn out. A single outer end of the third coil 23 and that of the fourth coil 24 and a single inner end of the inductance adjustment conductor 26 and that of the inductance adjustment conductor 27 are drawn out.

Each of the inductance adjustment conductors 26 and 27 preferably includes three current paths. Selectively trimming the current paths produces combinations of the current paths. The selection enables the adjustment of the inductance of the antenna coil unit for the set of the third coil 23 and the fourth coil 24.

Structures of the other components preferably are substantially the same as those in the first to third preferred embodiments.

In FIG. 6, the wiring pattern illustrated outside the flexible substrate 5 is a wiring pattern provided on a circuit board to which the antenna coil 204 is to be mounted. This wiring pattern on the circuit board connects the inner end of the first coil 21 to the inner end of the second coil 22. That is, the first coil and the second coil are connected in series. The inner end of the inductance adjustment conductor 27 is connected to the outer end of the third coil 23, and the inner end of the inductance adjustment conductor 26 is connected to the outer end of the fourth coil 24. That is, the third coil and the fourth coil are connected in parallel. In such a way, eight terminals of the coil connections of the antenna coil 204 are converted into four terminals on the circuit board. For example, the set of the first and second coils is used as a transmitting antenna, and the set of the third and fourth coils is used as a receiving antenna.

As described above, an antenna coil unit for reception and an antenna coil unit for transmission can be freely formed by the use of the wiring pattern on the circuit board to which the antenna coil is mounted. The circuit board is typically a multilayer wiring board, for example. Accordingly, it is fairly easy to connect the third coil and the fourth coil using a wiring pattern on the circuit board.

Fifth Preferred Embodiment

A structure of an antenna device according to a fifth preferred embodiment will be described with reference to FIG. 7.

Figure 7:
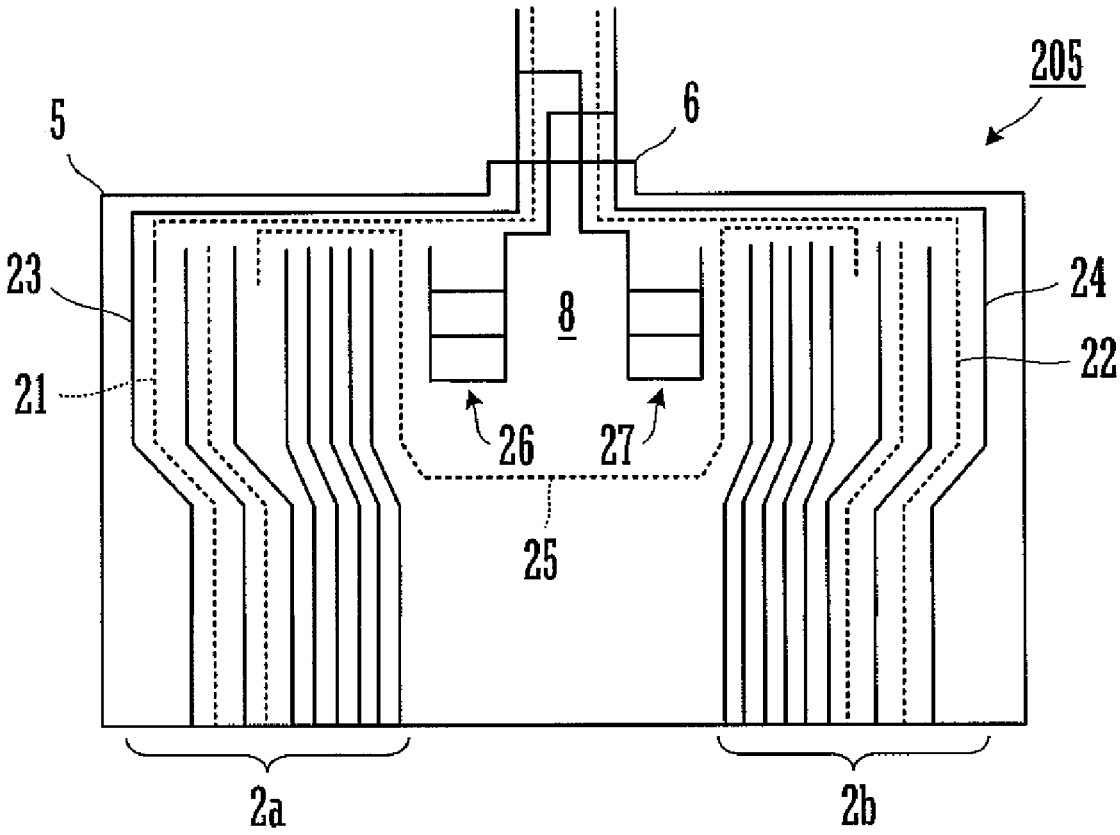
FIG. 7 is an illustration that shows a structure of an antenna coil according to a fifth preferred embodiment of the present invention.

FIG. 7 illustrates a structure of an antenna coil 205 according to the fifth preferred embodiment. FIG. 7 is a developed plan view that shows a structure of a flexible substrate before the flexible substrate is wound on a magnetic core and also illustrates a portion of a conductor pattern on a circuit board to which the antenna coil is to be mounted. The magnetic core is substantially the same as in the first, second and fourth preferred embodiments, so it is omitted in the drawing.

As illustrated in FIG. 7, the antenna coil 205 according to the fifth preferred embodiment includes a single flexible substrate 5 to be wound around the magnetic core. A conductor is provided on the surface of the flexible substrate 5. The conductor defines a first coil portion 2*a* and a second coil portion 2*b* around the magnetic core. Specifically, the first coil portion 2*a* includes, for example, a first coil 21 including 2.5 turns and a third coil 23 including 8 turns. Similarly, the second coil portion 2*b* includes, for example, a second coil 22 including 2.5 turns and a fourth coil 24 including 8 turns.

The winding direction of the first coil 21 to the coil axis is opposite to that of the second coil 22. The winding direction of the third coil 23 to the coil axis is opposite to that of the fourth coil 24.

The inner end of the first coil 21 and the inner end of the second coil 22 are electrically connected using a connecting conductor 25.

Inductance adjustment conductors 26 and 27 electrically connected to the inner end of the third coil 23 and the inner end of the fourth coil 24, respectively, are provided on the surface of the flexible substrate 5.

The flexible substrate 5 includes a projection 6 located at an intermediate position of one longer side thereof. At the projection 6, a single outer end of the first coil 21 and that of the second coil 22 are drawn out. A single outer end of the third coil 23 and that of the fourth coil 24 and a single inner end of the inductance adjustment conductor 26 and that of the inductance adjustment conductor 27 are drawn out.

Structures of the other components preferably are substantially the same as those in the first to fourth preferred embodiments.

In FIG. 7, the wiring pattern illustrated outside the flexible substrate 5 is a wiring pattern disposed on a circuit board to which the antenna coil 205 is to be mounted. This wiring pattern on the circuit board connects the inner end of the inductance adjustment conductor 27 to the outer end of the third coil 23 and connects the inner end of the inductance adjustment conductor 26 to the outer end of the fourth coil 24. That is, the third and fourth coils are connected in parallel. In such a way, six terminals of the coil connections of the antenna coil 205 are converted into four terminals on the circuit board. For example, the set of the first and second coils is used as a transmitting antenna, and the set of the third and fourth coils is used as a receiving antenna.

As described above, an antenna coil unit for reception and an antenna coil unit for transmission can be freely formed by the use of the wiring pattern on the circuit board to which the antenna coil is mounted.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An antenna coil comprising:

a magnetic layer;

a transmission coil portion defined by a coiled conductor;

a reception coil portion defined by a coiled conductor;

a transmission coil connection defined by a conductor and defining a portion of the transmission coil portion; and a reception coil connection defined by a conductor and defining a portion of the reception coil portion; wherein the transmission coil portion and the reception coil portion are at least partly arranged side by side on the magnetic layer;

the transmission coil portion and the reception coil portion are arranged to be connected to a wiring pattern on an external circuit; and the transmission coil connection and the reception coil connection are each drawn out from the transmission coil portion and the reception coil portion, respectively.

2. The antenna coil according to claim 1, wherein the transmission coil portion and the reception coil portion are arranged on a same flat magnetic layer.

3. The antenna coil according to claim 2, wherein the coiled conductor is formed on a flexible substrate.

4. The antenna coil according to claim 1, wherein:

each of the transmission coil portion and the reception coil portion includes conductors arranged in a plurality of rows; and each of the conductors defining the transmission coil portion and each of the conductors defining the reception coil portion are alternately arranged.

* * * * *